US010480284B2

(12) United States Patent
Watson

(10) Patent No.: US 10,480,284 B2
(45) Date of Patent: Nov. 19, 2019

(54) BALANCED VALVE ASSEMBLY

(71) Applicant: Silverwell Energy Ltd., Foxton, Cambridgeshire (GB)

(72) Inventor: Peter Watson, Essex (GB)

(73) Assignee: Silverwell Energy LTD. (GB)

( * ) Notice: Subject to any disclaimer, the term of this patent is extended or adjusted under 35 U.S.C. 154(b) by 91 days.

(21) Appl. No.: 15/381,063

(22) Filed: Dec. 15, 2016

(65) Prior Publication Data

US 2018/0171751 A1 Jun. 21, 2018

(51) Int. Cl.
*E21B 34/10* (2006.01)
*E21B 34/06* (2006.01)
*E21B 43/12* (2006.01)

(52) U.S. Cl.
CPC ..... *E21B 34/10* (2013.01); *E21B 34/066* (2013.01); *E21B 43/12* (2013.01)

(58) Field of Classification Search
CPC ..... E21B 34/10; E21B 34/101; E21B 34/066; E21B 43/12
See application file for complete search history.

(56) References Cited

U.S. PATENT DOCUMENTS 4,340,088 A * 7/1982 Geisow ..... E21B 34/101 137/629
4,471,841 A * 9/1984 Rector, Jr. ..... E21B 34/06 166/325
4,519,574 A * 5/1985 Roper ..... E21B 21/10 251/31
4,796,699 A * 1/1989 Upchurch ..... E21B 23/04 166/250.17
5,000,215 A * 3/1991 Phillips ..... F16K 1/385 137/15.18
5,865,272 A * 2/1999 Wiggins ..... F16H 25/2018 185/40 R
6,325,153 B1 * 12/2001 Harrell ..... E21B 34/066 166/324
6,364,023 B1 * 4/2002 Hiron ..... E21B 34/066 166/373
6,619,388 B2 * 9/2003 Dietz ..... E21B 34/066 166/332.8
7,743,833 B2 * 6/2010 Cascario ..... E21B 34/10 166/332.8
8,464,799 B2 * 6/2013 Scott ..... E21B 34/066 166/373
9,810,343 B2 * 11/2017 Miller ..... F16K 31/1223
2002/0108747 A1 * 8/2002 Dietz ..... E21B 34/066 166/66.7
2009/0188662 A1 * 7/2009 Casciaro ..... E21B 34/10 166/53

(Continued)

FOREIGN PATENT DOCUMENTS

EP 1018593 A1 * 7/2000 ..... E21B 34/066
WO WO-02059457 A1 * 8/2002 ..... E21B 34/066

*Primary Examiner* — Jennifer H Gay
(74) *Attorney, Agent, or Firm* — Bracewell LLP; Constance G. Rhebergen

(57) ABSTRACT

A downhole tool has a pressure differential from one side of the tool to the other. The pressure differential is balanced across the actuating assembly and tool surfaces to minimize the force required to move a portion of the tool, such as a valve, between a first position to a second position, such as when opening or closing a downhole valve.

13 Claims, 9 Drawing Sheets

(56) References Cited

U.S. PATENT DOCUMENTS

| | | | | |
|---|---|---|---|---|
| 2009/0301780 | A1* | 12/2009 | Gearhart | E21B 47/011 175/48 |
| 2010/0319779 | A1* | 12/2010 | Harms | E21B 49/10 137/1 |
| 2011/0132618 | A1* | 6/2011 | Panian | E21B 41/00 166/373 |
| 2011/0186303 | A1* | 8/2011 | Scott | E21B 34/066 166/373 |
| 2013/0008647 | A1* | 1/2013 | Dirksen | E21B 21/103 166/250.01 |
| 2015/0369005 | A1* | 12/2015 | Vick, Jr. | E21B 34/14 166/319 |
| 2017/0261120 | A1* | 9/2017 | Miller | F16K 31/1223 |
| 2017/0342804 | A1* | 11/2017 | Poluchalla | E21B 34/14 |
| 2017/0356277 | A1* | 12/2017 | Kleppa | F16K 41/10 |
| 2018/0171751 | A1* | 6/2018 | Watson | E21B 34/10 |

* cited by examiner

BALANCED VALVE ASSEMBLY

FIELD OF INVENTION

Embodiments of the present invention generally relate to methods and apparatuses for a downhole operation. More particularly, the invention relates to methods and apparatuses for controlling the flow of fluids from a hydrocarbon formation into the interior of the tubular.

BACKGROUND

When producing an oil or gas well it is desirable to control the fluid flow into or out of the production tubular, for example, to balance inflow or outflow of fluids along the length of the well. For instance, some horizontal wells have issues with a heel and toe effect, where differences in pressure or the amount of the various fluids that are present at a particular location can lead to premature gas or water breakthrough significantly reducing the production from the reservoir. Inflow control devices have been positioned in the completion string at the heel of the well to stimulate inflow at the toe and balance fluid inflow along the length of the well. In another example, different zones of the formation accessed by the well can produce at different rates. Inflow control devices may be placed in the completion string to reduce production from high producing zones, and thus stimulate production from low or non-producing zones. In some instances a sliding sleeve or other valve may be placed in a well where there is a significant pressure differential between a first side of the valve and another side of the valve requiring significance amount of power to open or close the valve.

In line with the need to control the flow of fluids into or out of an oil and gas well it may be desirable to have partial flow positions controllable at any position from fully open to fully closed and all positions between. Such control and in particular partial flow positions typically require relatively substantial amounts of power to overcome the inertia of the valve, corrosion, debris in the valve shift path, or most usually the high relative pressure differentials that exist within a well. Unfortunately most wells are located in remote locations or at extreme distances downhole where high power circuits, such as electrical or hydraulic, are not available.

SUMMARY

The concepts described herein encompass various types of actuating assemblies for downhole tools where a pressure differential exist from one side of the tool to another side of the tool. In order to minimize the force required to actuate the tool the areas across which the various pressures act are balanced in conjunction with various forces acting on the internal components of the tool such as the drive assembly, including any motor, gears, pulleys, or any spring or friction forces that may exist.

In a preferred embodiment a valve seals fluid flow from a first side to a second side where a higher pressure exists on the first side and a lower pressure exists on the second side. By incorporating a first and second bellows assembly where the first bellows is exposed to the lower pressure and the second bellows is exposed to the higher pressure and then balancing the surface areas exposed to the various pressures, the force required to open the valve against the higher pressure is minimized.

In alternative embodiments one or both bellows may be replaced by a piston sealed to a bore. It is also envisioned that multiple bellows where pistons may be used in the presence of either the higher pressure or lower pressure. Additionally it is foreseen that the balanced pressure assembly may be used to actuate any downhole tool where a higher pressure exists on one side and a lower pressure exists on another side.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In an embodiment of the invention the valve incorporates a balancing system that balances the internal and external pressures to minimize the forces required to switch the valve between an open condition and a closed condition. In addition to being shifted to an open or closed position the balanced valve may be opened to any partially open position. In certain instances, the switch between an open condition and a closed condition occurs in the presence of high pressure, high flow rates, or both.

Figure 1:
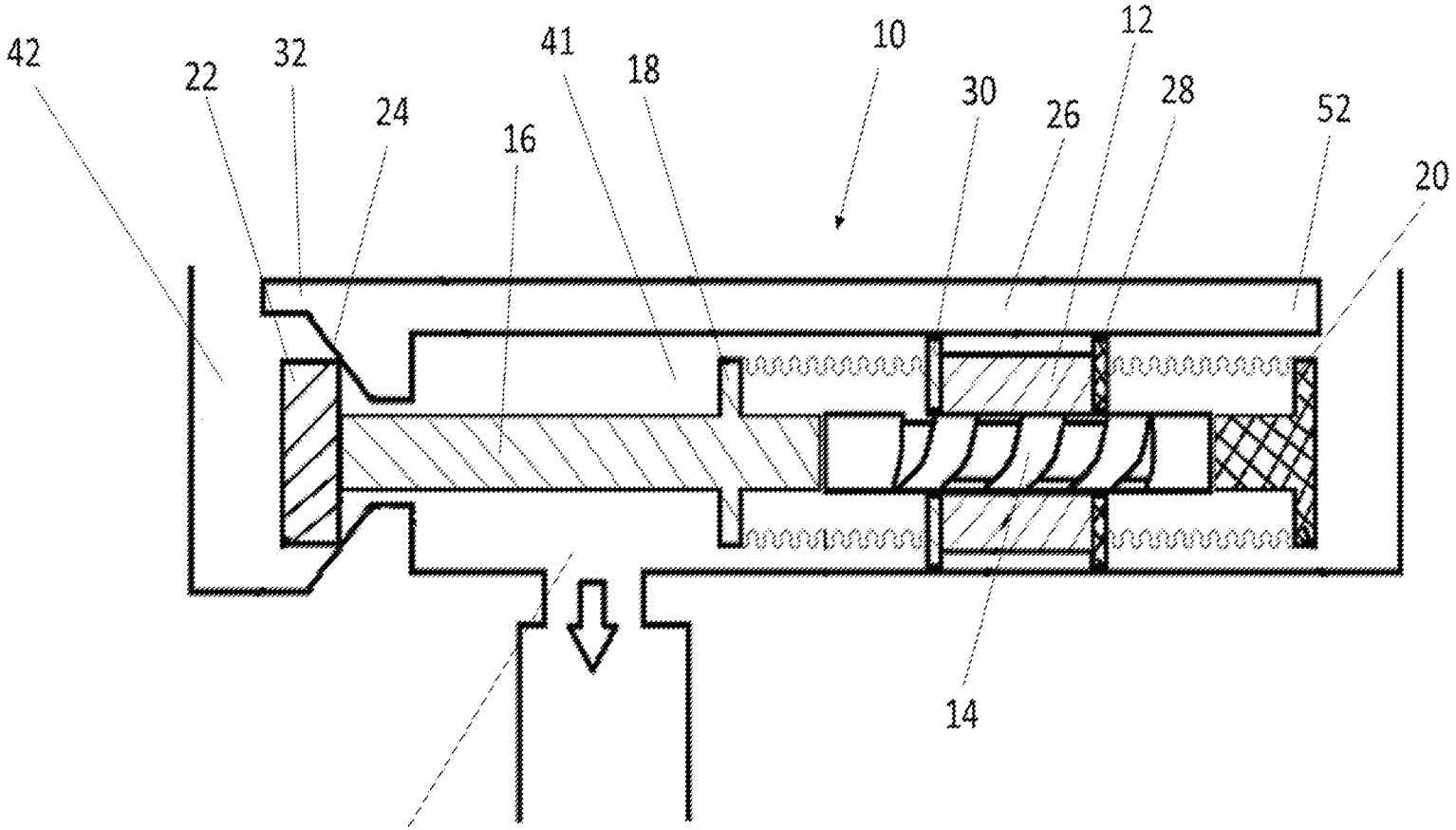
FIG. 1 depicts an embodiment of the invention wherein the valve incorporates a balancing system.

FIG. 1 depicts a balanced valve 10 having a motor 12. The balanced valve 10 generally consists of a housing 26 having a throughbore 41. Within the housing 26 is the motor 12, where the motor 12 has a first end 28 and a second end 30. Additionally, the housing typically includes a valve seat 24 at the inlet end 32 of the housing 26. The motor 12 is depicted as a rotating electric motor. It is envisioned that any primary driver such as a bi-stable electric actuator, a step electric motor, a hydraulic motor, a linear electric motor, or an air driven motor may be used as motor 12. The motor 12 is fixed in place and a leadscrew 14 is driven by the motor 12. The leadscrew 14 may be formed into a portion of valve stem 16 and is generally used as a gear reduction to provide additional mechanical advantage allowing a less powerful motor 12 to shift the valve stem 16. Other gear reduction methods may be used as well. In certain instances, direct drive without gears or gear reduction may be utilized. It is envisioned that by balancing the forces acting upon valve stem 16 via the bellows, the internal pressure, the external pressure, friction, inertia, and others a small motor 12 may move the valve stem 16 with or without mechanical advantage. The valve stem 16 has a first bellows actuating assembly 18 and at least a second bellows actuating assembly 20. In certain instances, it is envisioned that each bellows actuating assembly may utilize multiple bellows either in series or in parallel. For instance, if the pressure differential is very high it may be beneficial to have an outer bellows as well as at least one inner bellows to step the pressure down to a level that can the bellows or valve assembly can tolerate. The valve stem 16 also has at least one valve 22 where the valve 22 seats and thereby seals against the seat 24.

It is envisioned that the valve 22 may be lifted off of seat 24 an intermediate distance X to allow differing amounts of fluid to flow past the valve 22. For instance, motor 12 could be a rotary stepper motor such that a command is sent to the motor 12 or power is applied from the surface to motor 12 such that a number of rotations is caused that correlates to the valve 22 being partially off of seat 24 and thus being neither fully open or fully closed. In such a case a partial flow condition would exist past valve 22 and seat 24.

In FIG. 1 the balanced valve 10 is shown with valve 22 seated against seat 24. The pressure of the fluid in the upstream or external region 42 is the common pressure ($P_{CA}$) and acts externally upon the balance valve 10. The pressure of the fluid in the downstream or internal region 44 is the outlet pressure ($P_O$) and is the pressure of the fluid after it passes valve 22 from the external region 42 to the internal region 44.

It has been found that to facilitate low-power operation the pressures acting upon the valve stem 16 preferably have net forces that equal or very nearly equal zero in order to minimize the load on the motor 12. To minimize the net forces, it has been found that the area of the various pistons formed by surfaces attached to valve stem 12 must be matched.

Figure 2:
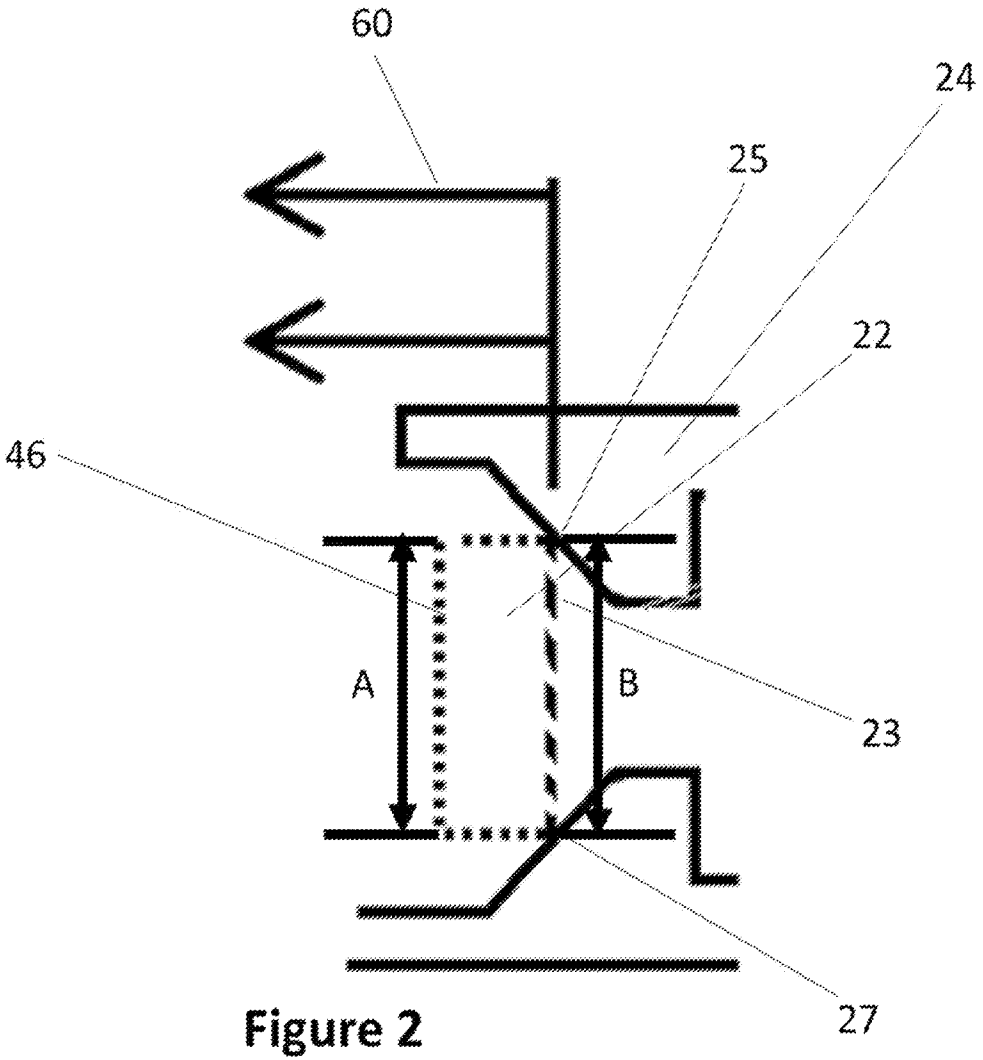
FIG. 2 depicts the portion of the balanced valve where the valve intersects the valve seat.

FIG. 2 depicts the portion of the balanced valve 10 where valve 22 intersects the valve seat 24 including a portion of the external region 42 as well as a portion of the internal region 44. Second Surface 23, having area B, is the portion of valve 22 that contacts seat 24 circumferentially about second surface 23 and faces the interior region 44. In the two dimensional drawing of FIG. 2 second surface 23 can be thought of as contacting seat 24 at points 25 and 27. First surface 46, having area A, is the portion of valve 22 facing the external region 42. Area A is equal to area B. Because first surface 46 faces the external region 42, first surface 46 is subject to the common pressure, $P_{CA}$, while second surface 23 facing the internal region 44 is subject to the outlet pressure, $P_O$.

Figure 3:
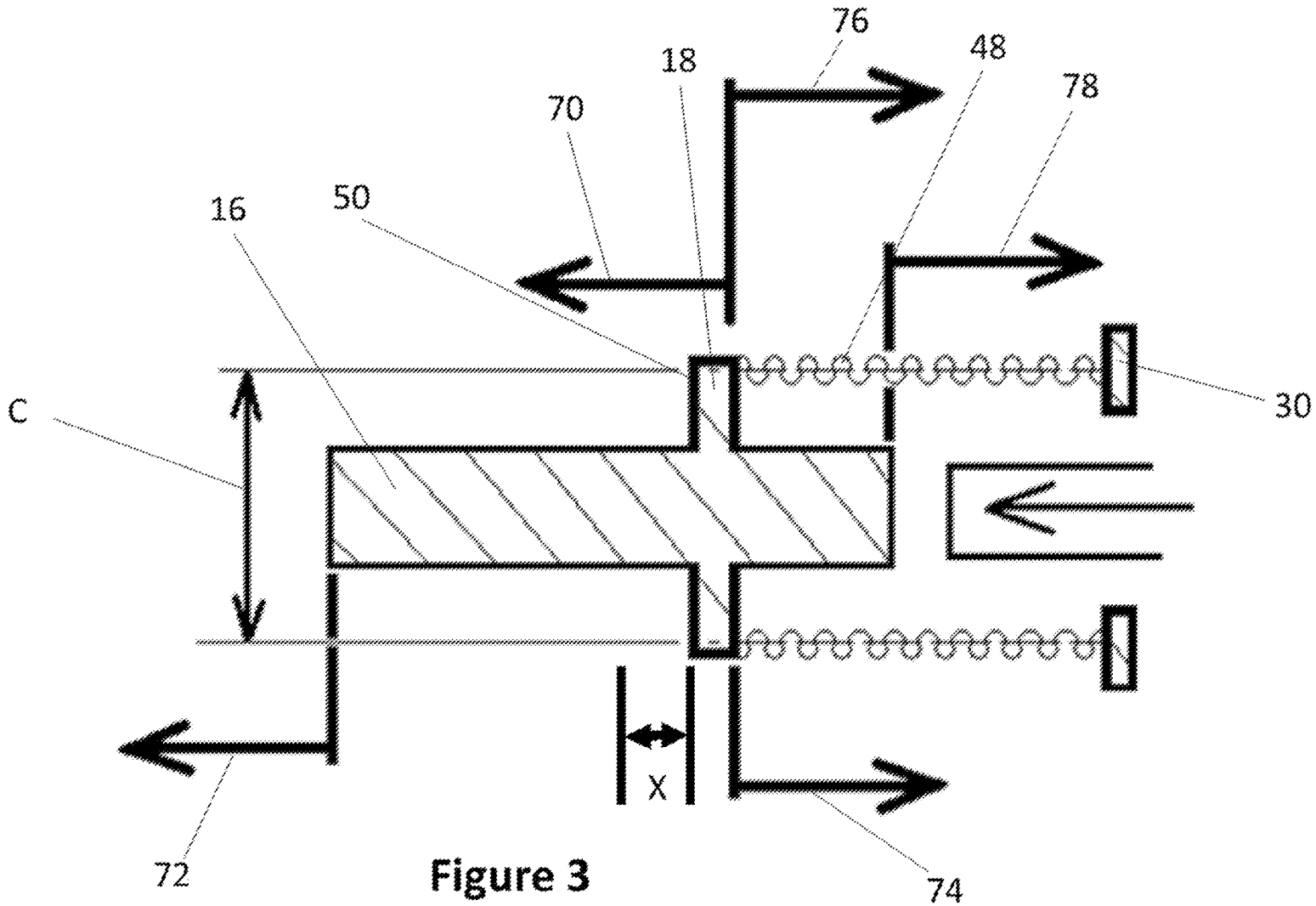
FIG. 3 is a depiction of the first bellows actuating assembly.

FIG. 3 is a depiction of the first bellows actuating assembly 18. The first bellows actuating assembly 18 generally consists of a portion of the valve stem 16, a first actuating rod surface 50 attached to the valve stem 16, a first bellows 48 wherein the first bellows 48 is attached on its first end to the first actuating rod surface 50 and on its second end to the housing second end 30. The first actuating rod surface 50 has an area C. Generally, within housing 26 the motor 12's first end 28 and second end 30 are sealed both to housing 26 and to lead screw 14 or at least to valve stem 16. With valve 22 seated against seat 24 and motor 12 sealing the throughbore 41 against the ingress of fluid at the common pressure $P_{CA}$, the area C of the first actuating rod surface 50 is subject to outlet pressure, $P_O$.

Also, seen in FIG. 3 are a number of forces acting upon valve stem 16. The direction and magnitude of movement of the valve stem 16 is herein referenced to the first diaphragm surface 50 and is shown by arrow 70. Generally, the magnitude of movement of the valve stem 16 is given in X increments. The force on the valve, $F_{BP}$, is indicated by arrow 72. In this instance the bellows has a mechanical property giving it some characteristics of a spring. In certain instances, it may be necessary to add a spring or other bias device to the system. The bellows spring rate is k. The bellows force due to the bellows spring is, $F_{AS}$, and is indicated by arrow 74. $F_{AS}$ may be found by multiplying the bellows spring rate times the number of increments of movement of the valve stem to which the bellows is coupled where:

$$F_{AS}=k\cdot X$$

The force on the valve stem 16 exerted against the bellows through the diaphragm surface 50 due to the outlet pressure $P_O$ is indicated by arrow 76 and is referred to as $F_{AB}$. $F_{AB}$ may be found by multiplying the area C of the first diaphragm surface 50 by the outlet pressure $P_O$, where:

$$F_{AB}=C\cdot P_O$$

The force on the valve stem 16 due to the motor reaction force, $F_{BM}$, is indicated by arrow 78. $F_{BM}$ may be found:

$$F_{BM}=F_{BP}-F_{AS}-F_{AB}$$

Figure 4:
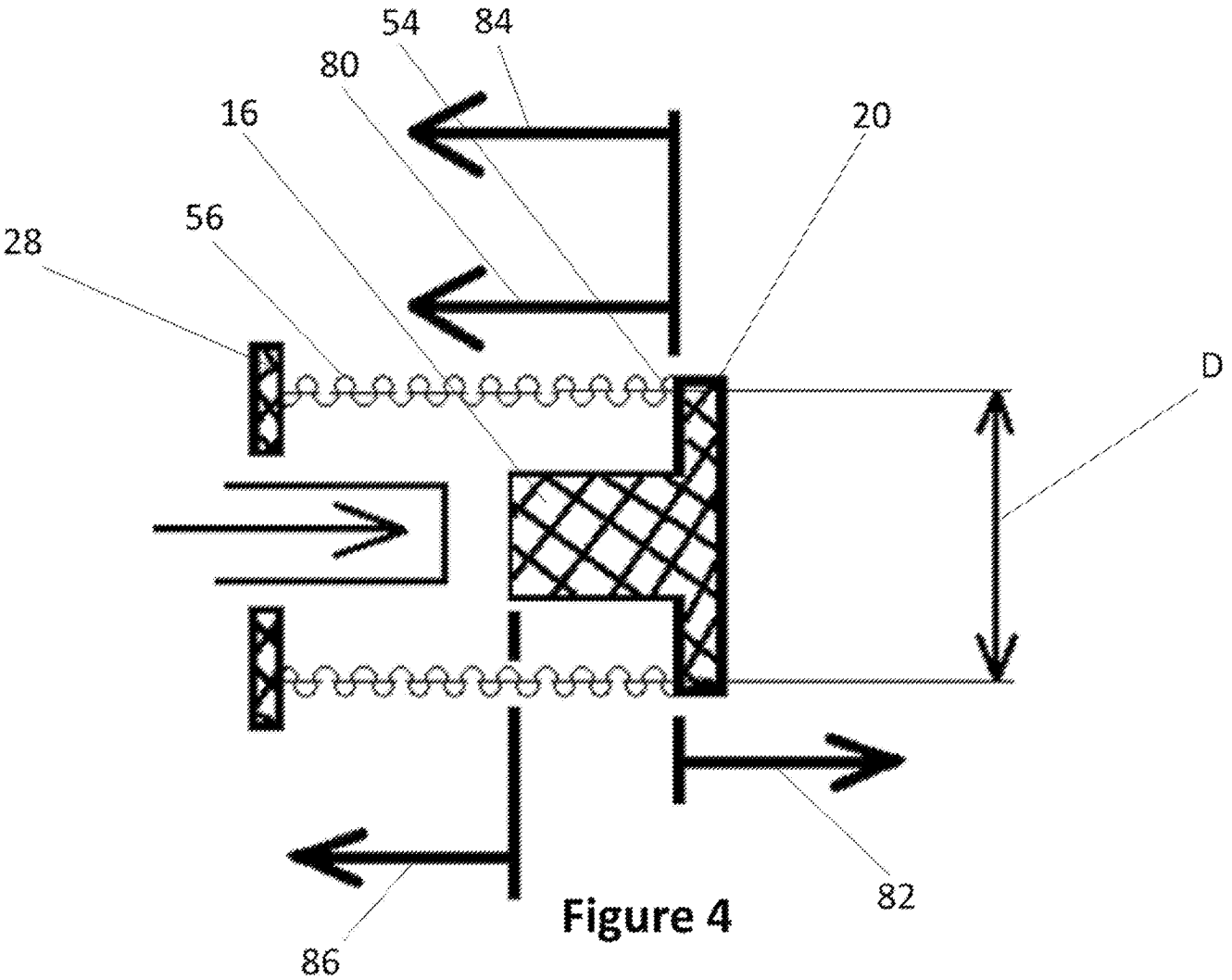
FIG. 4 is a depiction of the second bellows actuating assembly.

FIG. 4 is a depiction of the second bellows actuating assembly 20. The second bellows actuating assembly 20 generally consists of a portion of the valve stem 16, a second actuating rod surface 54 attached to the valve stem 16, a second bellows 56 wherein the second bellows 56 is attached on its first end to the second actuating rod surface 54 and on its second end to the housing first end 28. The second actuating rod surface 54 has an area D. Generally, within housing 26 the motor 12's first end 28 and second end 30 are circumferentially sealed both to housing 26 and to lead screw 14 or at least to valve stem 16. With valve 22 seated against seat 24 and motor 12 sealing the distal end 52 of housing 26 against the ingress of fluid at the common pressure $P_{CA}$, the area D of the second actuating rod surface 54 is subject to common pressure $P_{CA}$.

Also, seen in FIG. 4 are a number of forces acting upon valve stem 16. The direction and magnitude of movement of the valve stem 16 is herein referenced to the second diaphragm surface 54 and is shown by arrow 80. The force, $F_{CAM}$, on the leadscrew 14 is indicated by arrow 86. Generally, the magnitude of movement of the valve stem 16 is given in "X" increments. Again, the bellows 56 has a mechanical property giving it some characteristics of the spring. The bellows 56 is in this instance is matched to bellows 48 and has the same spring rate k. In other embodiments, the bellows and springs thereof may not match. The bellows force due to the bellows spring rate is, $F_{AS}$, and is indicated by arrow 82. $F_{AS}$ may be found by multiplying the bellows spring rate times the number of increments of movement of the valve stem to which the bellows is coupled where:

$$F_{AS}=k\cdot X$$

The force on the valve stem 16 exerted against the bellows through the diaphragm surface 54 due to the common pressure $P_{CA}$ is indicated by arrow 84 and is referred to as $F_{BCA}$. $F_{BCA}$ may be found by multiplying the area D of the second diaphragm surface 54 by the common pressure $P_{CA}$, where:

$$F_{BCA}=D\cdot P_{CA}$$

In general terms the balanced valve 10 minimizes the force required by the motor 12 to actuate the valve 22 by ensuring that the net forces acting upon valve 22 are equalized. To equalize the net forces acting on valve 22 each of the areas A and D, that are subject to the common pressure, $P_{CA}$, are engineered to have equal areas. In addition, each of the areas B and C, that are subject to the outlet pressure, $P_O$, are engineered to have equal areas. However, because areas A and B are, in actuality, the two sides of the same valve, therefore area A=area B. In turn across the entire system area A=area B=area C=area D. while it is preferred that the opposing areas subject to the same pressure are equal, in certain instances it is forseen that it may be necessary to engineer areas that are not equal in order to create forces to offset internal forces within the valve which may be due to spring affects, friction, or other internal forces.

Figure 5:
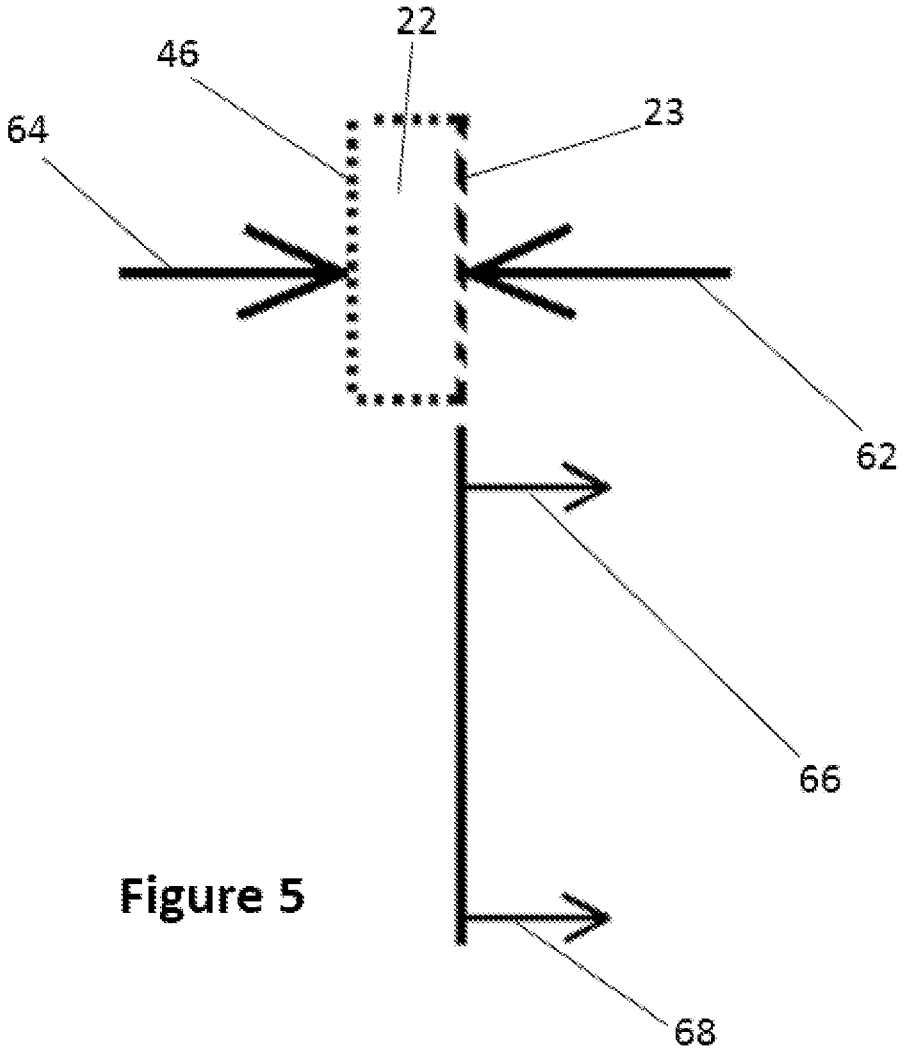
FIG. 5 is a diagram of the forces acting upon opposing surfaces of valve.

Returning to FIG. 2 arrow 60 denotes the valve seat reaction force, $F_R$. FIG. 5 is a diagram of the forces acting upon surfaces 23 and 46 of valve 22. Arrow 62 denotes the force, $F_{VI}$, acting upon surface 23 of valve 22. Arrow 64 denotes the force, $F_{VO}$, acting upon surface 46 of valve 22.

It may also be seen that in the closed condition the forces on the valve due to the valve seat reaction force, $F_R$, is equal to but opposing the force of the valve seat, $F_S$, such that:

$$F_R=F_S$$

Figure 6:
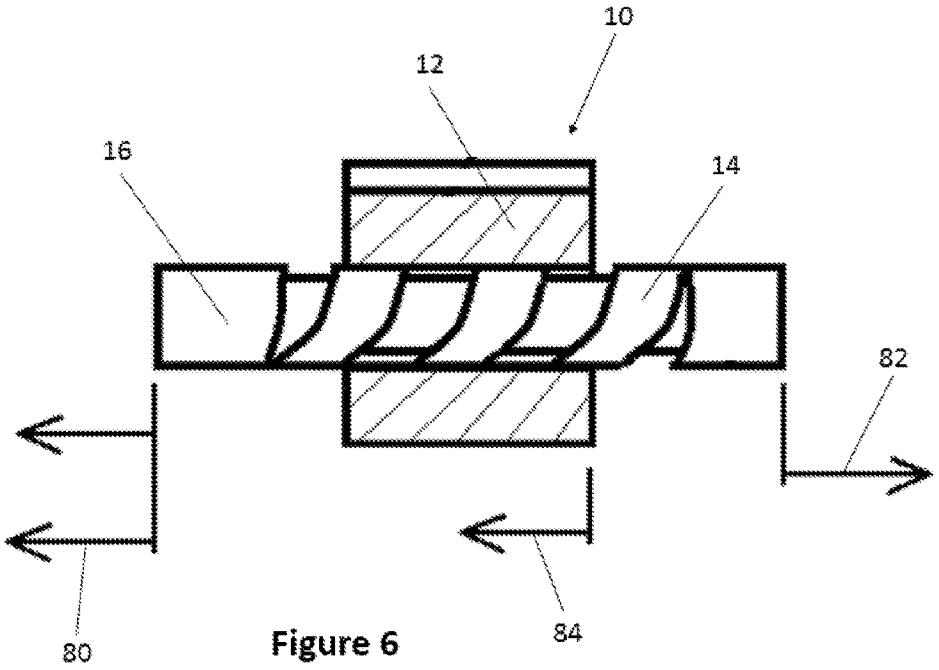
FIG. 6 is a depiction of various forces acting upon the motor, the lead screw, and portions of the valve stem.

FIG. 6 is a depiction of the drive assembly of the balanced valve and includes various forces acting on a portion of the balance valve 10. In particular, the motor 12 the lead screw 14 and portions of the valve stem 16 are depicted. As can be seen in the embodiment shown in FIG. 6 the lead screw 14 is formed as part of the valve stem 16. Arrow 80 depicts the force, $F_{ABR}$, acting on the lead screw 14 and valve stem 16 as a result of the outlet pressure, $P_O$, acting upon the first bellows 18. Arrow 82 depicts the force, $F_{CB}$, acting on the lead screw 14 and valve stem 16 as a result of the common pressure, $P_{CA}$, acting upon the second bellows 20. Arrow 84 depicts the force, $F_M$, acting on the lead screw 14 and valve stem 16 as a result of the motor 12. In the steady-state summing the forces gives:

$$F_{ABR}-F_M-F_{CB}=0$$

Figure 7:
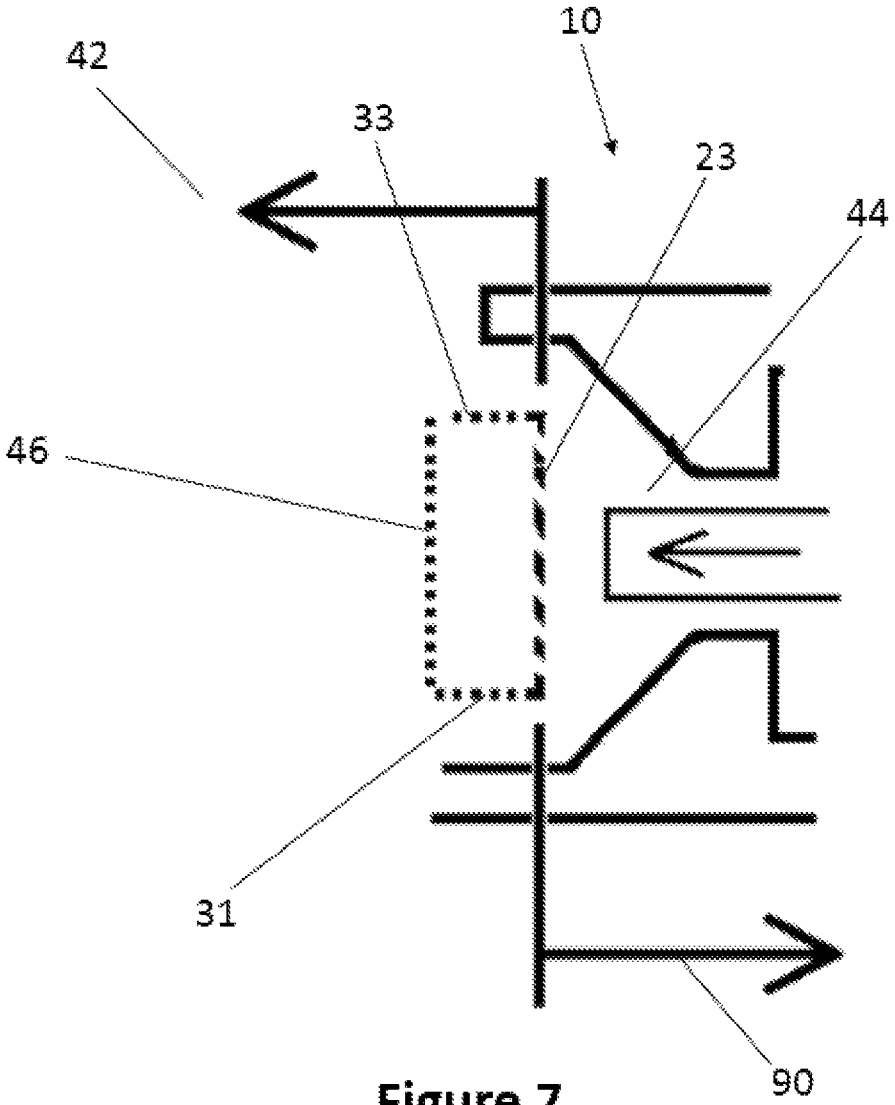
FIG. 7 is a depiction of various forces on the valve, the valve seat, and a portion of the valve stem.

FIG. 7 is a depiction of various forces on a portion of the balance valve 10 and in particular includes the valve 22 and the valve seat 24 and a portion of the valve stem 16. FIG. 7 indicates the condition of the balance valve 10 when the valve 22 is off of valve seat 24 allowing fluid to flow between the external region 42 to the internal region 44. As before valve 22 has surface 23 indicated by the diagonal dashed lines, having an area B, and a surface 46 indicated by the dotted lines, having an area A. For clarity in this two-dimensional representation, surface 46 includes surfaces 31 and 33 however because surfaces 31 and 33 are diametrically opposed and both are subject to the common pressure, $P_{CA}$, the forces acting upon surfaces 31 and 33 cancel each other. As in FIGS. 1 and 2, surface 46 of valve 22 is acted upon by common pressure, $P_{CA}$, of the fluid in the upstream or external region 42, while surface 23 of valve 22 is acted upon by outlet pressure, $P_O$, of the fluid in the downstream or internal region 42. Arrow 90 depicts the forces, $F_{VO}$ and $F_{VI}$, where:

$$F_{VO}=A*P_{CA}$$

$$F_{VI}=B*P_O$$

Figure 8:
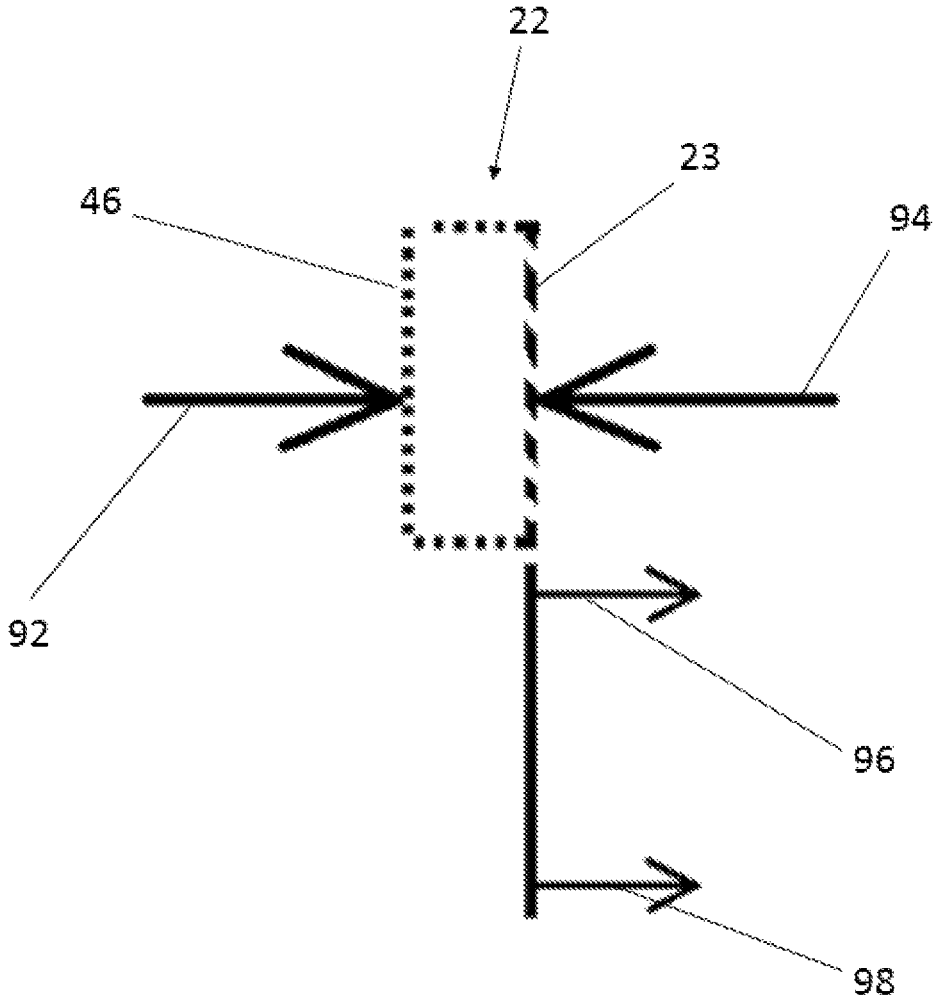
FIG. 8 is a detail of the valve, to valve surfaces, and the forces acting upon each surface.

FIG. 8 is a detail of valve 22, surface 46, surface 23, and the forces acting upon each surface. Arrow 92 depicts the force, $F_{VO}$, on the outside of the valve. Arrow 94 depicts the force, $F_{VI}$, on the inside of the valve. Arrow 96 depicts the force, $F_V$, due to actuated bellows acting upon the valve stem 16 through a bellows pin. Arrow 98 depicts the force, $F_F$, due to the flow of fluid past the open valve.

The various forces are found as follows:

$$F_{VO}=\text{area } A\times P_{CA}$$

$$F_{VI}=\text{area } B\times P_O$$

$$F_R=F_S$$

Additionally, as seen in FIG. 5 the forces acting upon valve 22 are the force on the actuator bellows pin, $F_V$, denoted by arrow 66 and the force on the valve seat, $F_S$, denoted by arrow 68.

The force on the actuators bellows pin, $F_V$, may be found as follows:

$$F_V=F_{VI}-F_{VO}-F_S$$

Similarly, for the actuated bellows the equal and opposite reaction force to $F_V$ is the force on the valve $F_{BP}$.

Summing the forces across the system for the valve closed case we can see that:

$$F_{VI}-F_{VO}-F_S-F_{AB}-F_{AS}+F_M+F_{BCA}-F_{AS}=0$$

However, as the forces:

$$F_{VO}=F_{BCA} \text{ and } F_{VI}=F_{AB}$$

The above terms cancel each other out.

Therefore:

$$-F_S-F_{AS}+F_M-F_{AS}=0$$

Then rearranging for the force on the valve seat and collecting terms the forces may be restated as:

$$F_M-2*F_{AS}=F_S$$

Showing that by closely matching the bellows and valve sizes the forces on the motor can be minimized by careful consideration of the opening distance (X) and bellows spring rate (k). This also shows that by balancing the spring rate and the maximum travel distance against the motor power you can maximize the valve force on the seat to increase valve seal integrity.

Equally for the stable Open valve case we can see that:—

The force exerted by the motor ($F_M$) on the assembly is balance by the assembly reaction force ($F_{MR}$) so they cancel out.

$$F_M-F_{MR}=0$$

$$\text{Where } F_M=F_M-F_{VO}-F_F-F_{AS}+F_{BCA}-F_{AS}-F_{AB}$$

However as previously stated the forces $$F_{VO}=F_{BCA} \text{ and } F_{VI}=F_{AB}$$

The above terms cancel each other out.

Therefore $$F_M=-F_F-F_{AS}+-F_{AS}$$

$$\text{or } FM=-F_F-2F_{AS}$$

This shows that assuming that valve diameter and bellows diameters are balanced then the size of the motor is dependent only on the valve opening distance, spring rate of the two bellows and by the amount of force due to flow through the valve.

Figure 9:
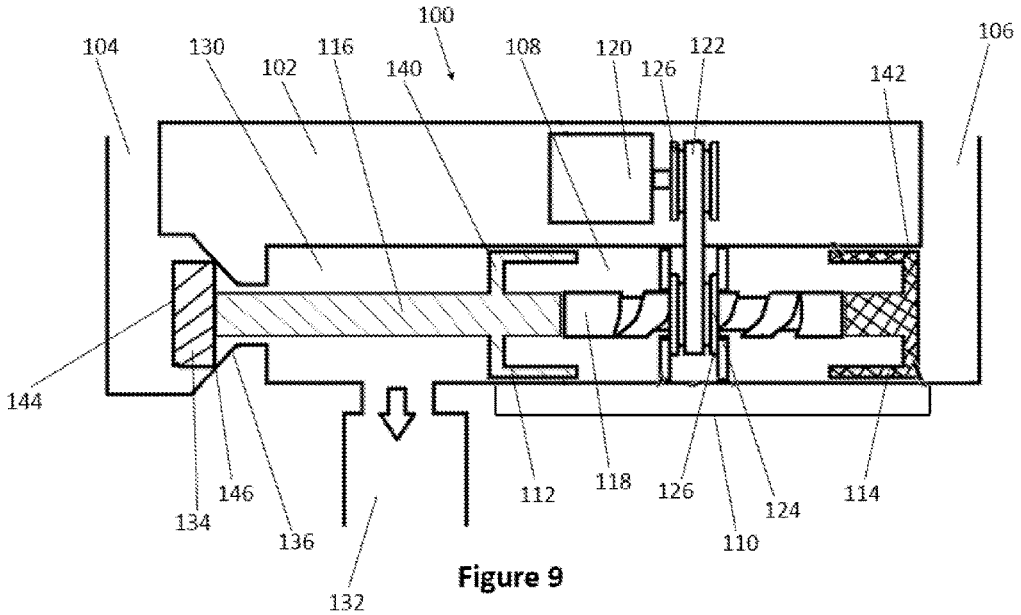
FIG. 9 shows an alternative embodiment of the current invention of balanced valve.

FIG. 9 shows an alternative embodiment of the balanced valve 100. Balanced valve 100 has a housing 102 where housing 102 is exposed to the common pressure, $P_{CA}$, at upper end 104 and at lower end 106. Balanced valve 100 has a chamber 108. Within chamber 108 is an actuating assembly 110. Actuating assembly 110 typically consists of an upper piston 112 and a lower piston 114. Each of the upper piston 112 and the lower piston 114 is movably sealed to housing 102. Upper piston 112 include surface 140 while lower piston 114 include surface 142. Each of the upper piston 112 and the lower piston 114 is coupled to both valve stem 116 and to drive screw 118. As depicted in FIG. 9 the valve drive assembly generally consists of a motor 120 coupled to a drive belt 122 coupled to drive pulley 124. When the motor 120 is actuated pulley 126 is rotated. Drive belt 122 is rotated by pulley 126 and transfers the rotational movement to drive pulley 124. Drive pulley 124 is held in place by thrust bearings 126 so that as drive pulley 124 is rotated drive screw 118 is engaged forcing the valve stem 116 to move towards the upper end 104 or lower end 106 of housing 102. While this particular embodiment has a drive assembly that utilizes a belt drive with a lead screw, other drive assemblies could be used for instance the belt may be replaced with gears or a chain, while the drive pulley and drive screw may also be replaced with gears. In other versions, the drive screw could be magnetic allowing direct electromagnetic drive of the valve stem.

Additionally, the balanced valve 100 includes an outlet chamber 130 and an outlet 132 were both the outlet chamber 130 and the outlet 132 have a fluid at an outlet pressure, $P_O$. Generally, at the upper end 104 of housing 102 is a valve 134 and a valve seat 136. Valve 134 includes first surface 144 and second surface 146.

In the current embodiment, generally pistons 112 and 114 replace the bellows described in the previous embodiment. Additionally, the coaxial motor described in the previous embodiment has been replaced by an offset motor 120 and drive assembly.

While a valve has been depicted as primary embodiment of the current invention, in an alternative embodiment the motor and balanced pistons or bellows could be used to actuate any downhole tool where a high differential pressure exists from one side to the other.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it is understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A valve assembly for use downhole comprising:

a housing having a chamber;

an inlet formed through an end of the housing;

a valve element, selectively disposed in a first position in sealing engagement with the inlet to form a barrier between the chamber and an environment ambient to the housing, and selectively moveable to a second position spaced away from the inlet to provide fluid communication between the chamber and the environment;

an elongated valve stem disposed in the chamber having an end attached to the valve element, an opposite end distal from the valve element profiled with an enlarged radius;

a surface on a side of the opposite end of the valve stem facing away from the valve element that is in communication with the environment, and has an area substantially the same as an area of a side of the valve element facing away from the inlet;

a motor in the chamber and coupled to the valve stem;

a planar flange circumscribing the valve stem between the motor and the valve element, and having a radial surface facing the valve element with an area substantially the same as a surface area of the valve element in communication with the chamber when the valve element is in the first position;

actuating bellows having an end attached to the planar flange, and an opposite end attached to the motor; and matching bellows having an end attached to the opposite end of the valve stem, and an opposing end attached to the motor.

2. The valve assembly of claim 1, wherein the motor engages a lead screw formed along a portion of the valve stem.

3. The valve assembly of claim 1, wherein the ends of the actuated bellows are in sealing contact with the planar flange and the motor to define a sealed space between the actuated bellows and valve stem, and wherein a pressure in the sealed space is less than a pressure in the chamber.

4. The valve assembly of claim 1, wherein a spring rate of the actuated bellows is substantially the same as a spring rate of the matching bellows.

5. The valve assembly of claim 1, wherein a force exerted by the motor to move the valve element away from the inlet is based on spring rates of the actuating bellows and matching bellows.

6. The valve assembly of claim 1, wherein the matching bellows is in sealing engagement with the motor and the opposite end of the valve stem to define a sealed space between the matching bellows and the valve stem.

7. The valve assembly of claim 1, further comprising an outlet formed radially through a sidewall of the housing and that intersects the chamber.

8. The valve assembly of claim 7, wherein the environment is a well intersecting a hydrocarbon formation, and the outlet is in communication with a production tubular disposed in the well.

9. A valve assembly for use downhole comprising:

a housing defining an inner chamber;

an opening formed through the housing;

a motor in the chamber;

an elongated valve stem having a portion coupled with the motor, the valve stem moveable between open and closed configurations with actuation of the motor;

a valve element mounted on an end of the valve stem, the valve element engaging the opening when the valve stem is in the closed configuration to form a barrier to fluid communication between the chamber and an environment ambient to the housing;

a means for exerting an ambient balancing force to the valve stem, the ambient balancing force having a magnitude the same as, and a direction opposite to, a force exerted onto the valve element from a pressure of the environment ambient to the housing when the valve stem is in the closed configuration; and a means for exerting a chamber balancing force onto the valve stem, the chamber balancing force having a magnitude the same as, and a direction opposite to, a force exerted onto the valve element from a pressure inside the chamber when the valve stem is in the closed configuration.

10. The valve assembly of claim 9, wherein the means for exerting the ambient balancing force to the valve stem comprises an enlarged radial portion on an end of the valve stem opposite the valve element and having a surface area the same as a surface area of the valve element facing away from the opening, and a bellows having an outer end attached to a side of the enlarged radial portion facing the inlet and an inner end mounted to a rearward sidewall of the motor.

11. The valve assembly of claim 9, wherein the means for exerting the chamber balancing force to the valve stem comprises a flange on a portion of the valve stem between the valve element and motor, the flange having a radial surface area the same as a surface area of the valve element in communication with the chamber when the valve stem is in the closed configuration, and a bellows having an outer end attached to a side of the flange facing away from the valve element, and an inner end mounted to a forward sidewall of the motor.

12. The valve assembly of claim 9, wherein the means for exerting the ambient balancing force and the means for exerting the chamber balancing force each comprise bellows, and wherein a force generated by the motor to urge the valve stem into the open configuration is the same as a sum of spring forces in the bellows and a force of fluid flowing over the valve element.

13. The valve assembly of claim 9, wherein fluid from the environment flows into the chamber when the valve stem is in the open configuration, and wherein the fluid flows radially outward from the chamber through an outlet.

* * * * *